US007510359B2

(12) United States Patent
Sperry et al.

(10) Patent No.: US 7,510,359 B2
(45) Date of Patent: Mar. 31, 2009

(54) INFLATABLE DUNNAGE BAGS AND METHODS FOR USING AND MAKING THE SAME

(75) Inventors: Laurence Sperry, Newton, MA (US); Ross Patterson, Boston, MA (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 385 days.

(21) Appl. No.: 11/337,756

(22) Filed: Jan. 23, 2006

(65) Prior Publication Data

US 2007/0172326 A1 Jul. 26, 2007

(51) Int. Cl.
*B61D 45/00* (2006.01)

(52) U.S. Cl. ..... 410/119

(58) Field of Classification Search ..... 410/119, 410/125, 87

See application file for complete search history.

(56) References Cited

U.S. PATENT DOCUMENTS

| | | | | |
|---|---|---|---|---|
| 5,042,663 | A | 8/1991 | Heinrich | |
| 5,254,074 | A | 10/1993 | Landers et al. | |
| 5,339,602 | A | 8/1994 | Landers et al. | |
| 5,830,780 | A | 11/1998 | Dennison et al. | |
| 5,901,850 | A | 5/1999 | Jones et al. | |
| 6,253,806 | B1 | 7/2001 | Sperry et al. | |
| 6,253,919 | B1 | 7/2001 | Sperry et al. | |
| 6,398,029 | B1 * | 6/2002 | Farison et al. | 206/522 |
| 6,520,332 | B1 * | 2/2003 | Barmore et al. | 206/522 |
| 6,561,236 | B1 | 5/2003 | Sperry et al. | |
| 6,568,013 | B2 * | 5/2003 | Perez et al. | 5/710 |
| 6,569,283 | B1 * | 5/2003 | Sperry et al. | 156/583.2 |
| 6,729,110 | B2 | 5/2004 | Sperry et al. | |
| 6,934,989 | B2 * | 8/2005 | Ledvina et al. | 5/644 |

FOREIGN PATENT DOCUMENTS

| | | |
|---|---|---|
| WO | WO 98/14390 | 4/1998 |

OTHER PUBLICATIONS

Copy of International Search Report for corresponding International Application No. PCT/US2007/000459.

* cited by examiner

*Primary Examiner*—H Gutman
(74) *Attorney, Agent, or Firm*—Alston & Bird LLP

(57) ABSTRACT

An inflatable dunnage bag for filling empty space within a container is provided. The inflatable dunnage bag includes a bag portion and a valve assembly. The valve assembly is connected to the bag portion and defines a passageway through which a fluid is introduced into the bag portion during an inflation process. The valve assembly may include a backing plate, a flap, a projection, or combination thereof. The backing plate may be positioned between front and back walls of the valve assembly and be configured to protect the back wall from an inflation nozzle inserted through the front wall during the inflation process. The backing plate may include a flap adapted to further protect the back wall and help direct the fluid flow toward the bag portion. The projection, such as a hook, is configured to position the valve assembly to a predetermined area of the container.

19 Claims, 6 Drawing Sheets

INFLATABLE DUNNAGE BAGS AND METHODS FOR USING AND MAKING THE SAME

BACKGROUND OF THE INVENTION

1) Field of the Invention

Figure 1:
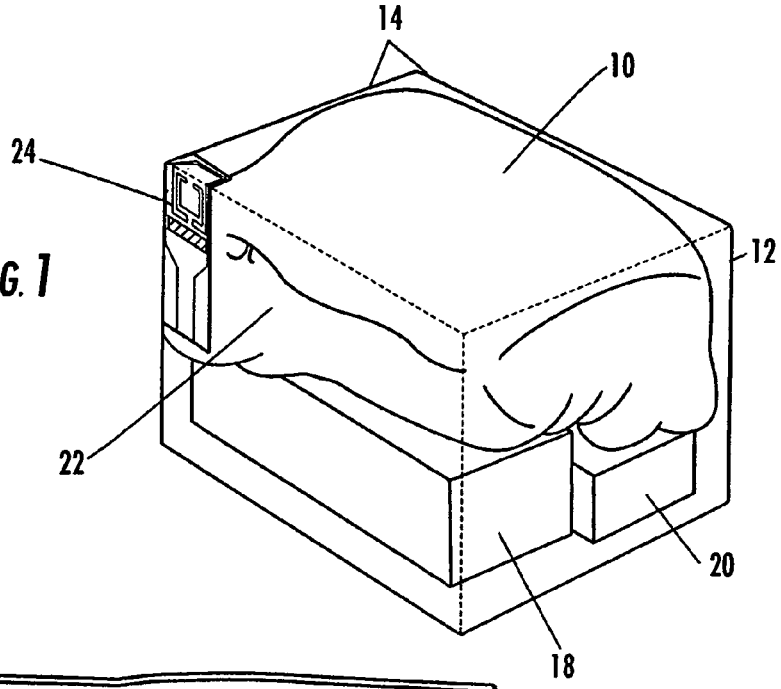

This present invention relates generally to inflatable packing materials, such as dunnage bags.

2) Description of Related Art

Inflatable packing materials, such as dunnage bags, are typically used to fill void regions in containers carrying goods or items for shipment. When the dunnage bag is inflated, the items are wedged between the dunnage bag and the walls of the container or between portions of the dunnage bag. Thus the items are restricted from moving around in the container while being shipped.

Dunnage bags or similar materials come in various designs, shapes and sizes. Some of them are configured to be inflated prior to placing them into the boxes or other containers as dunnage material. Others are inflated after they are placed into the container. The advantage of the latter type is that they can be inflated just enough to fill most, if not all, of the empty space that is present. Even though there are a great variety of available dunnage bags, there is room for improvement in their design so as to reduce cost and increase their ease of use.

For example, in the case of dunnage bags that are configured to be inflated after they are placed into the container, it has proven challenging to develop a method and a structure for inflating such bags in a low cost and efficient manner. A dunnage bag may be inflated by inserting an inflation nozzle through a connected valve assembly of the bag. Because the bag is already within the closed container, in order to access the valve assembly either the valve assembly must extend through the container or the inflation nozzle must enter the container to reach the valve assembly.

Some dunnage bags are configured such that their valve assembly extends through a wall of the container. However, the wall of some containers is sometimes not strong enough to support the valve assembly when the nozzle is being inserted into the valve assembly during the inflation process. And the valve assemblies of such bags are often too costly and cumbersome for use in a high volume environment, such as a warehouse or distribution center.

In other bags, the inflation nozzle is inserted through the container wall to the valve assembly of the bag. In such bags, the valve assembly is aligned near or adjacent a predetermined area of one of the container's walls so it is possible to insert the inflation nozzle blindly through the wall and engage the valve assembly. Some bags have used glue to adhere the valve assembly against an inner surface of the wall. However, such gluing is undesirable in that it requires several assembly steps including applying the glue, positioning the nozzle assembly in the desired location, and then allowing the glue to dry sufficiently to cause adhesion.

In light of the foregoing, it would be desirable to provide a structure for and method of inflating a dunnage bag within a container that allow for the proper and consistent alignment between the valve assembly within the container and the insertion of the inflation nozzle from outside the container. It would also be desirable to provide a device for holding the valve assembly against the outer wall during the inflation process and prevent the inflation nozzle from puncturing straight through the valve assembly.

BRIEF SUMMARY OF THE INVENTION

The features of the present invention address the above problems and provide a novel valve assembly, inflatable dunnage bag and associated methods. The valve assembly includes a backing plate which may include a projection, such as a hook, that provides an easy and consistent method of positioning the valve assembly within a container. The backing plate may also be configured to bias the valve assembly against an inner surface of a wall of the container. Biasing the valve assembly against the inner surface allows for an inflation nozzle to puncture through the wall of the container and the front side of the valve assembly without the need to separately adhere the valve assembly to the inner surface of the wall of the container. In order to help protect the back of the valve assembly from the inflation nozzle, the backing plate may include a flap that moves the back wall away from the nozzle during insertion. Also, the backing plate may be configured for flexibility in order to compensate for changes in the shape of the valve assembly during the inflation process.

Specifically, according to an embodiment of the present invention, the inflatable dunnage bag includes a bag portion, a valve assembly, and a backing plate. The valve assembly is connected to the bag portion for allowing an inflation process to inflate the bag portion. The backing plate has an upper portion that is foldable in a first direction and a lower portion. Folding the upper portion in the first direction encourages the lower portion to bias at least a portion of the valve assembly in a second direction which aids in the inflation process. The backing plate may comprise a resilient material.

In another embodiment, the valve assembly may have a front wall and a back wall. At least part of the backing plate may be positioned between the front wall and the back wall such that the backing plate protects the back wall from the inflation nozzle inserted through the front wall during the inflation process. The backing plate may further include a flap adapted to move the back wall away from the inflation nozzle and direct a fluid flow from the inflation nozzle through the valve assembly to the bag portion during the inflation process.

The backing plate may further have a projection for positioning the valve assembly. For example, the backing plate may have a hook that extends beyond the front wall and the back wall. The backing plate may also have a break in the material for added flexibility.

The valve assembly may also comprise a valve mechanism that allows a fluid into the bag portion during the inflation process and inhibits the fluid from escaping from the bag portion when the bag portion is inflated.

In another aspect, the present invention provides a supply of inflatable dunnage bags in roll form. The supply may include a tube of material and a plurality of valve assemblies. The tube of material may have a plurality of alternating first and second heat seals that define a plurality of dunnage bags. In particular, each first heat seal defines a bottom end of a bag while each second heat seal defines a top end of a bag. The tube may further include a plurality of lines of weakening for detaching the dunnage bags from the supply. The supply also includes a plurality of valve assembles. Each valve assembly is connected to a dunnage bag for allowing an inflation process to inflate the dunnage bag. And each valve assembly may have a backing plate that is substantially between a front wall and a back wall of the valve assembly. The backing plate is configured to protect the back wall from an inflation nozzle inserted through the front wall during the inflation process. The backing plate may further include a flap, a projection, or combination thereof.

The present invention also provides methods for using and making the dunnage bags. For example, according to one embodiment, the present invention provides a method for packaging an item for shipment. The method may include placing the item, a bag portion, and a valve assembly having a hook into a container and engaging the hook to the container so as to position the valve assembly near an outer wall of the container. Next, an inflation nozzle may be inserted through the outer wall of the container and into the valve assembly such that the bag portion may be inflated by introducing a fluid flow into the bag portion from the inflation nozzle and through an internal passageway defined by the valve assembly.

The method may also include a step of closing the container prior to inflating the bag portion. The valve assembly may include a flap which is engaged by the inflation nozzle such that the flap moves a back wall of the valve assembly away from the inflation nozzle and helps direct the fluid flow through the internal passageway.

In another embodiment, the present invention provides a method of making the inflatable dunnage bags. The method includes forming a plurality of spaced and transverse first seals along a tube of material. Each first seal defines a first end of a dunnage bag. The method also includes forming a transverse line of weakening on an upstream side of each first seal along the tube. Each line of weakening defines a second end of a dunnage bag, wherein each dunnage bag extends from a second end to a first end in an upstream direction. A valve assembly is inserted into each dunnage bag between a top layer and a bottom layer of the tube of material by opening a portion of each line of weakening. A second transverse seal is formed on an upstream side of each line of weakening along the tube such that the second transverse seal connects the valve assembly to the dunnage bag and seals the second end of the bag portion. The method may also include a step of rolling the dunnage bag into a supply roll.

BRIEF DESCRIPTION OF THE SEVERAL VIEWS OF THE DRAWING(S)

Figure 2A:
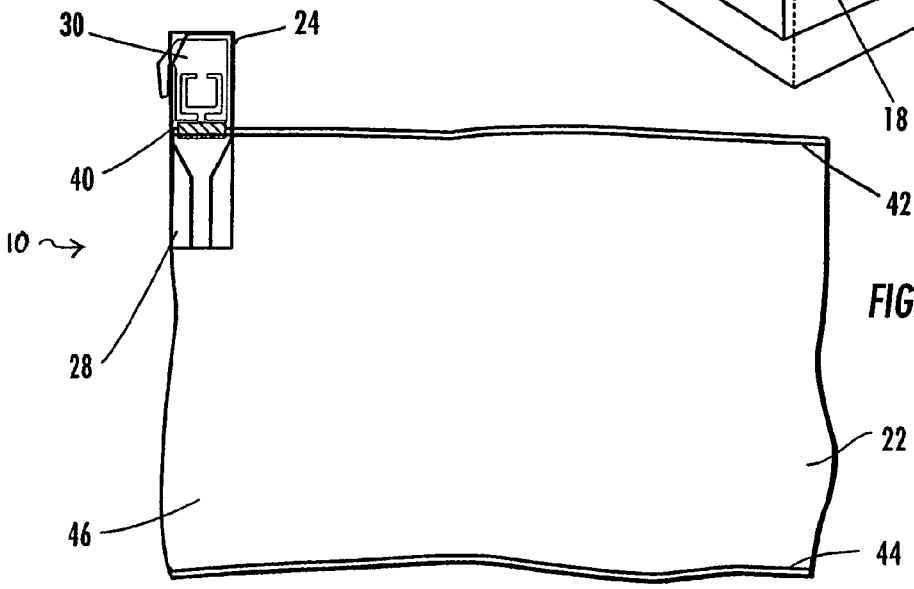
Figure 2B:
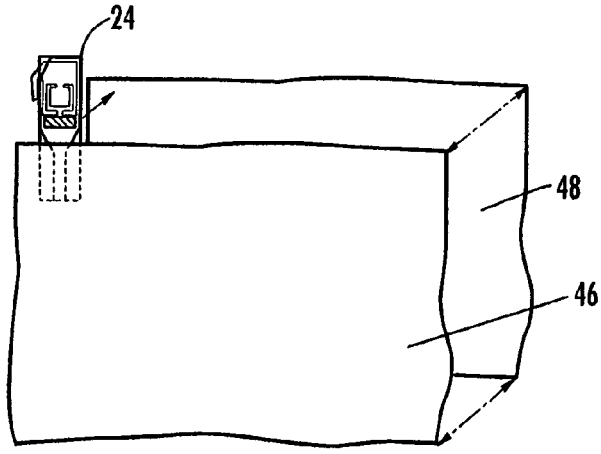
Figure 3A:
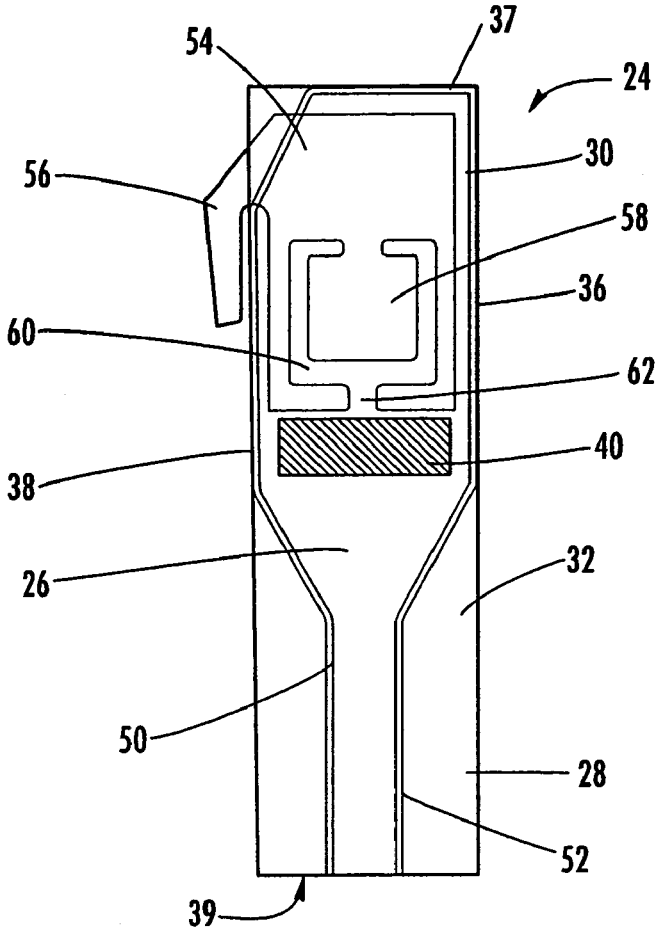
Figure 3B:
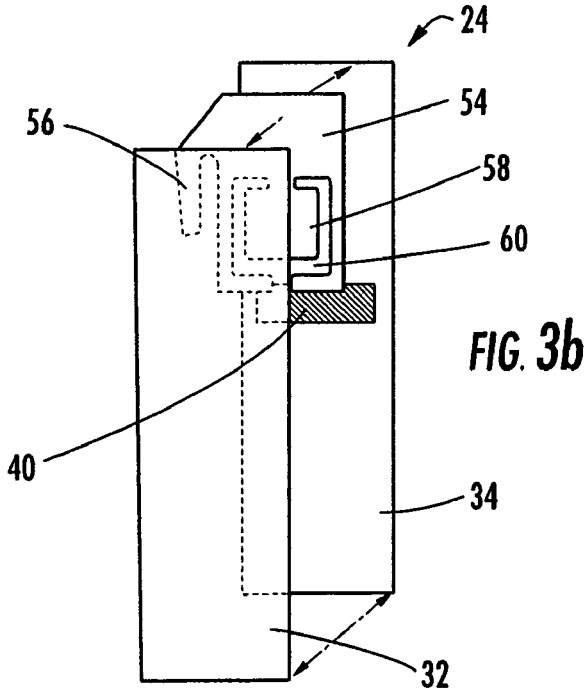
Figure 4A:
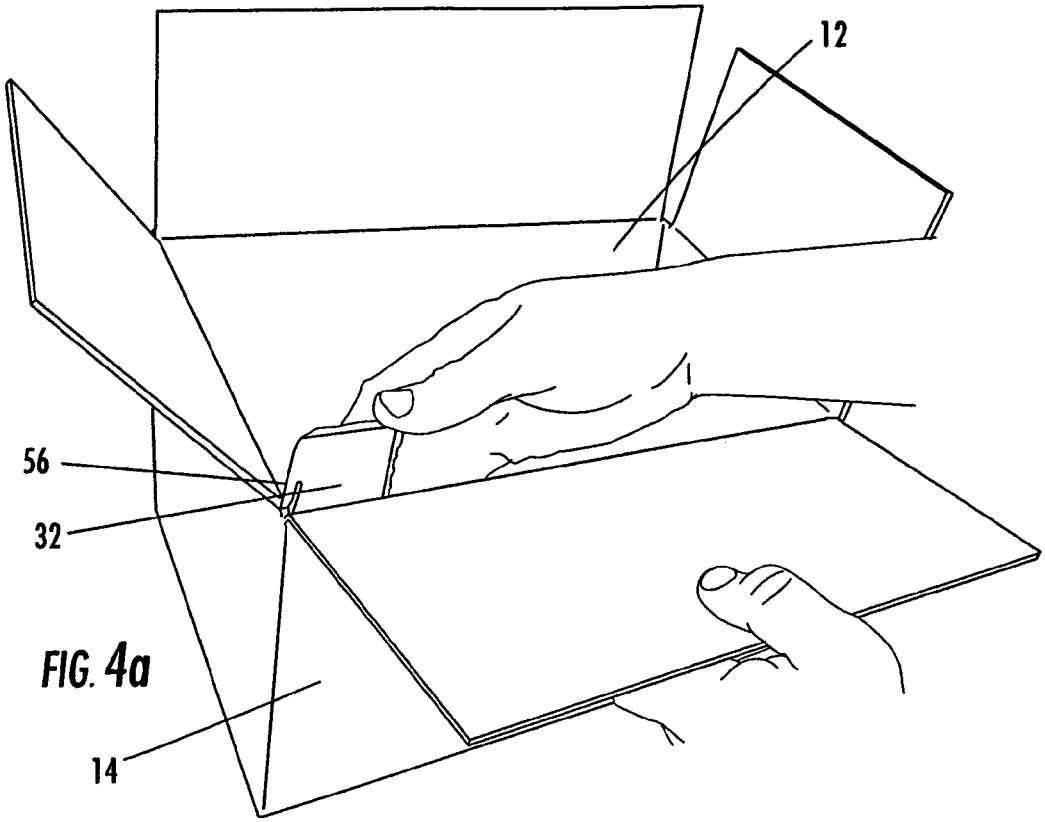
Figure 4B:
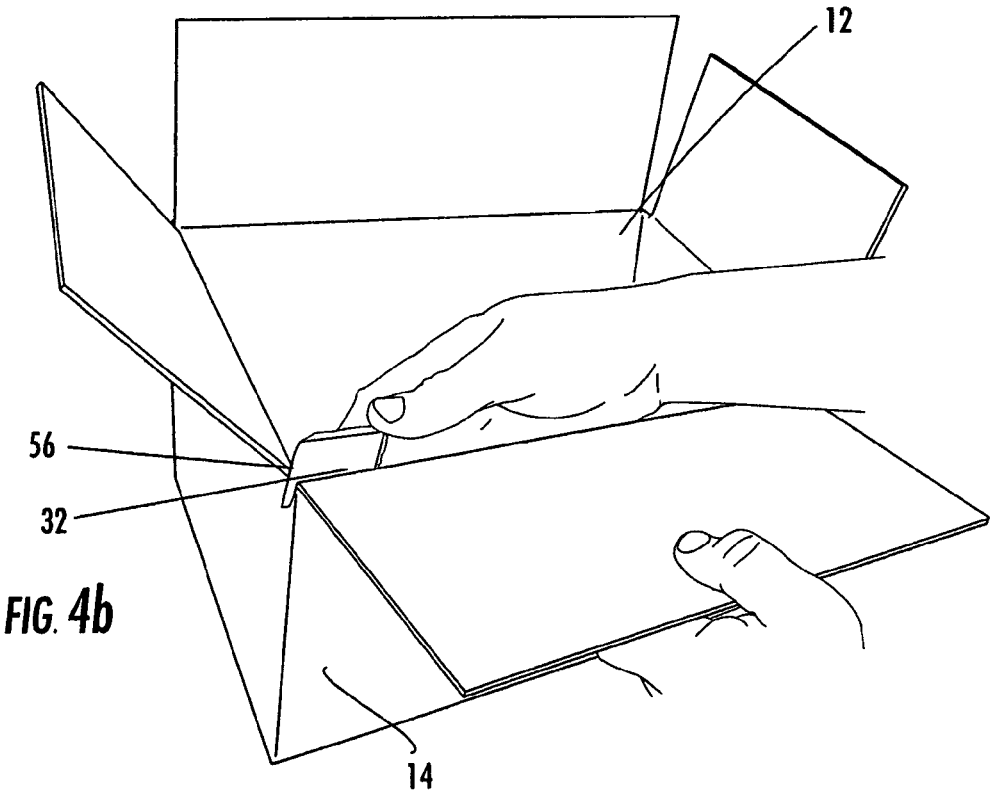
Figure 4C:
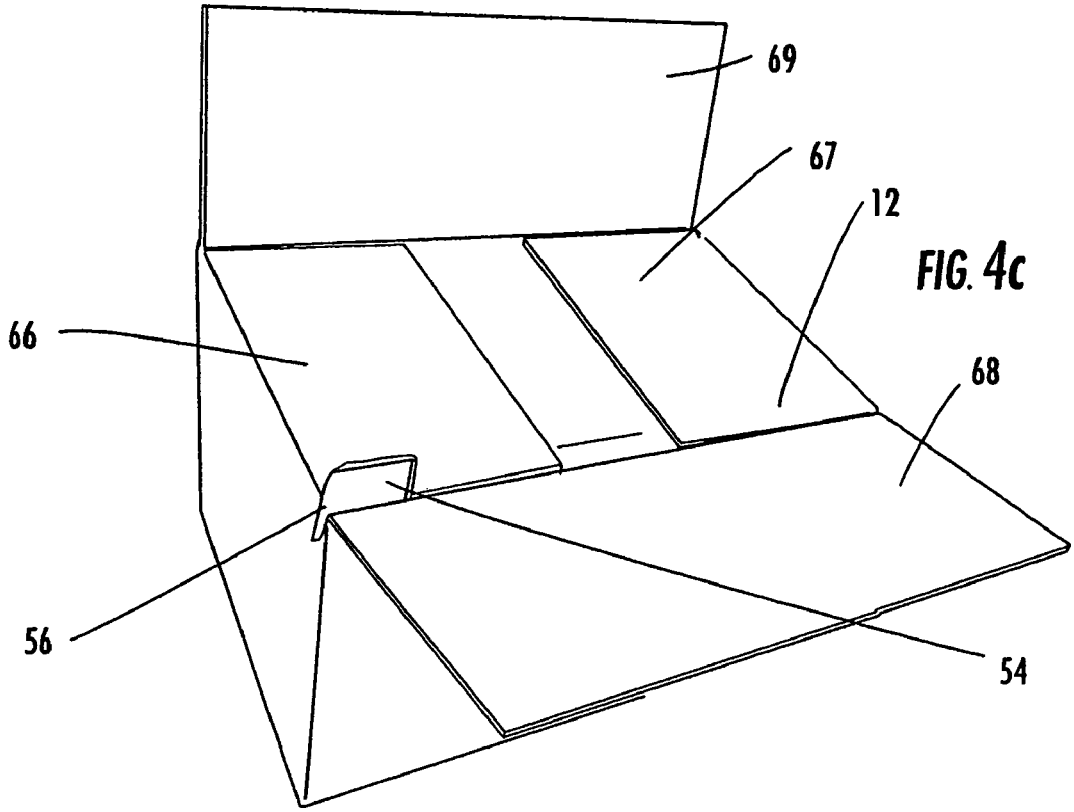
Figure 4D:
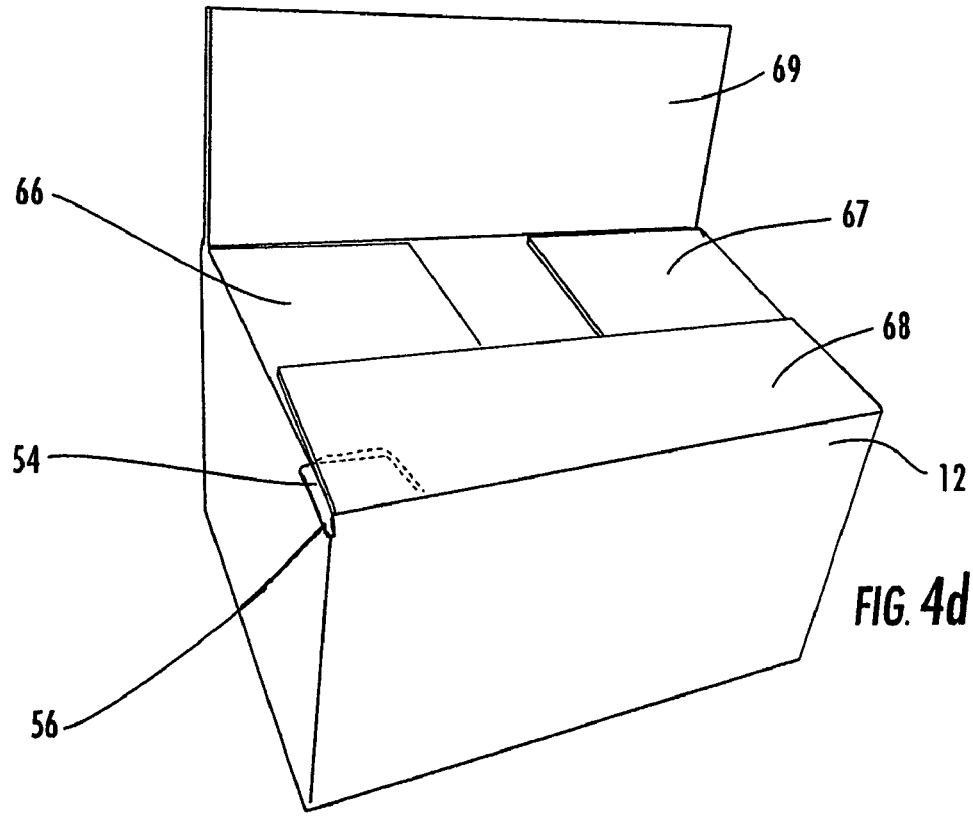
Figure 5A:
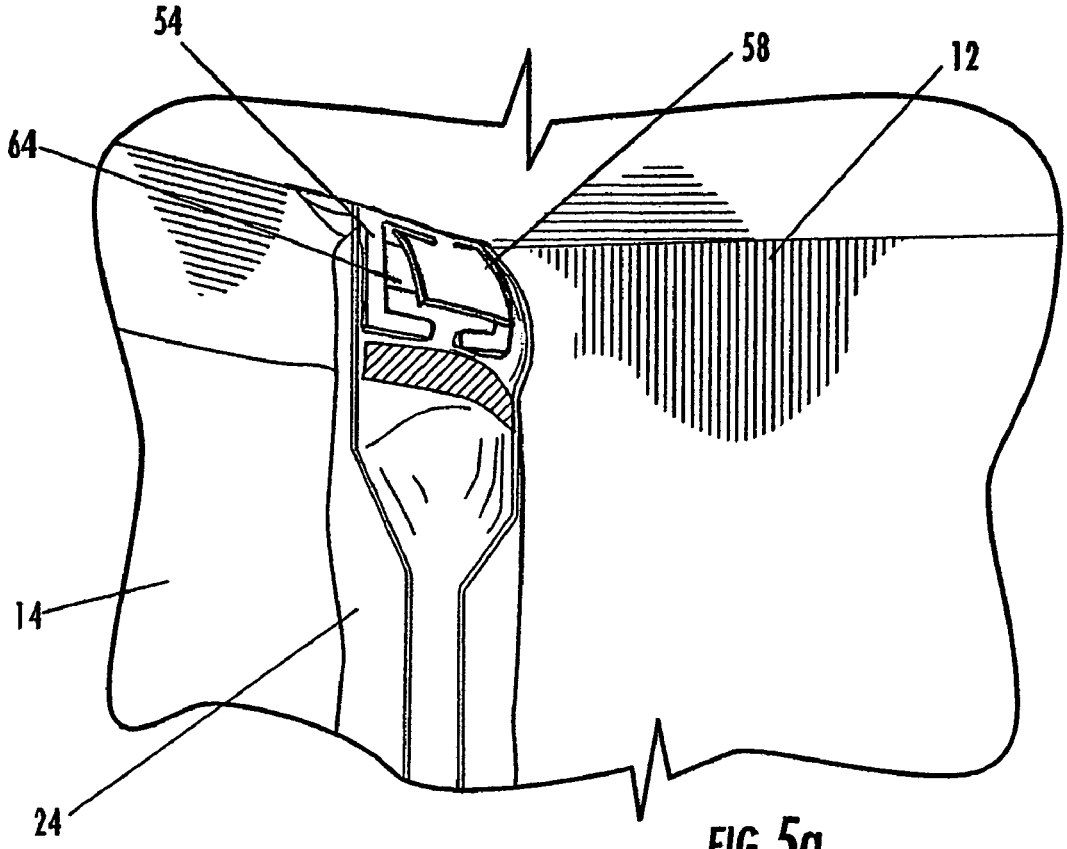
Figure 5B:
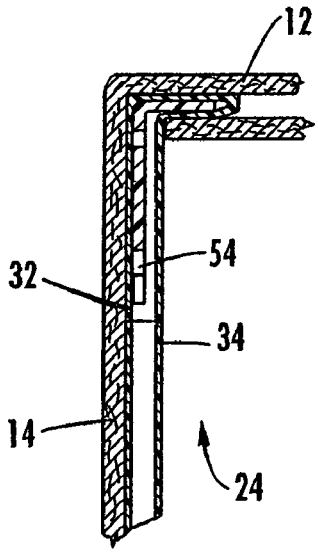
Figure 5C:
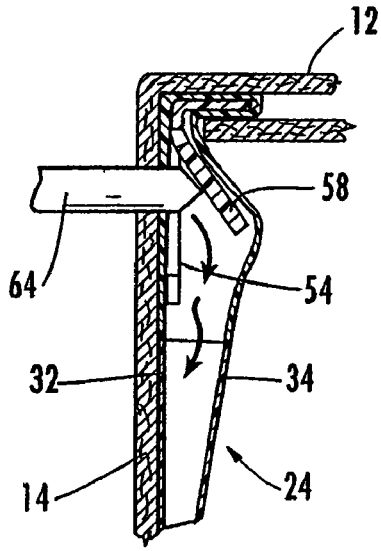
Figure 6:
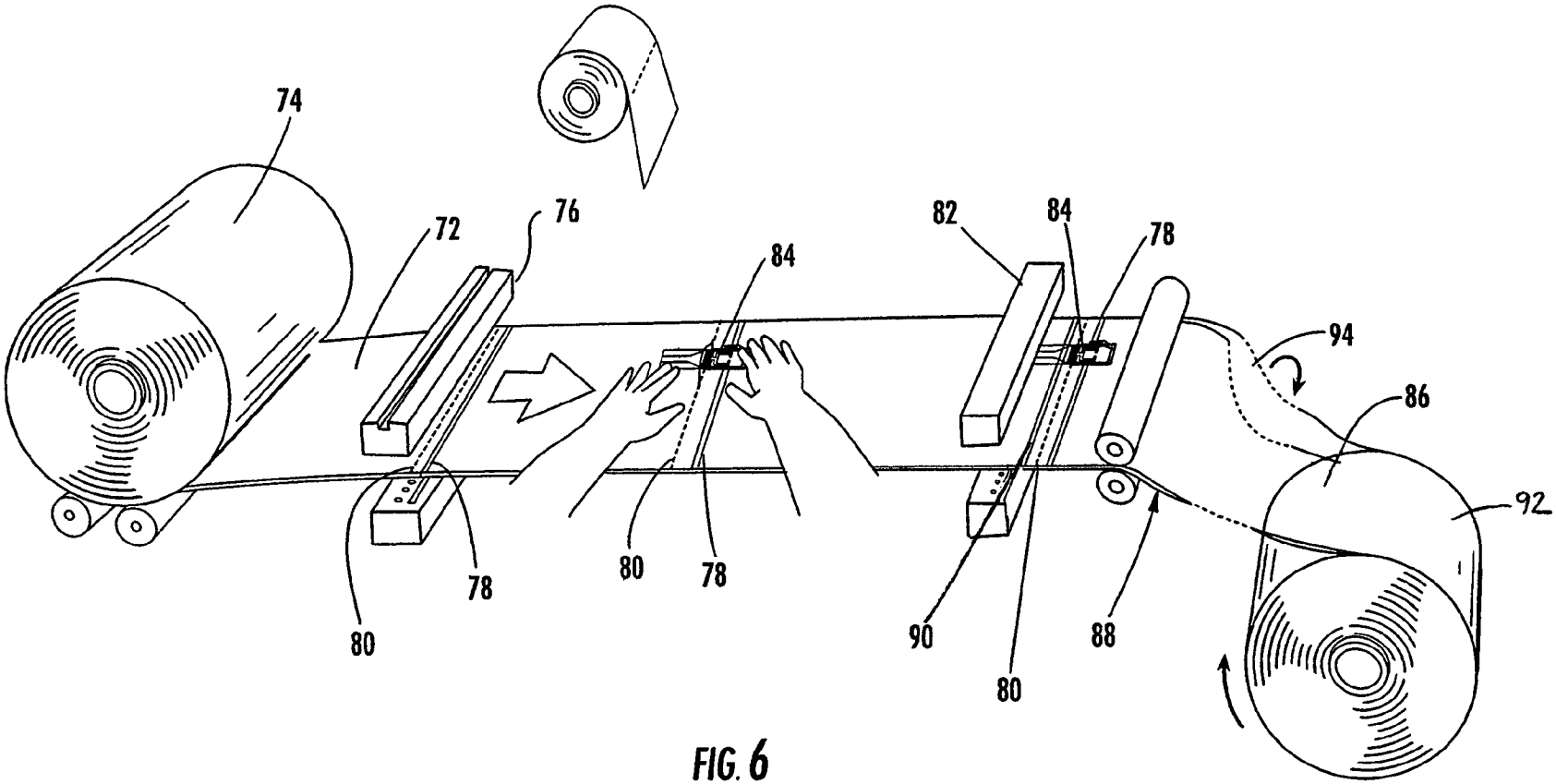

Having thus described the invention in general terms, reference will now be made to the accompanying drawings, which are not necessarily drawn to scale, and wherein:

FIG. 1 is a perspective view of an inflatable dunnage bag in use in a container according to an embodiment of the present invention;

FIG. 2*a* is a frontal view of the inflatable dunnage bag of FIG. 1, wherein the dunnage bag is in a non-inflated state;

FIG. 2*b* is an exploded view of the inflatable dunnage bag of FIG. 2*a* according to an embodiment of the present invention;

FIG. 3*a* is a valve assembly according to an embodiment of the present invention;

FIG. 3*b* is an exploded view of the valve assembly of FIG. 3*a* according an embodiment of the present invention;

FIG. 4*a* illustrates a hook of the valve assembly according to an embodiment of the present invention being positioned near a wall of the container;

FIG. 4*b* illustrates the hook of FIG. 4*a* engaging the wall of the container;

FIG. 4*c* illustrates the closing of the minor flaps generally perpendicular to the valve assembly;

FIG. 4*d* illustrates the closing of the major flaps generally parallel to the valve assembly;

FIG. 5*a* is a partial interior view of an inflation nozzle engaging the valve assembly according to an embodiment of the present invention;

FIG. 5*b* is a side view of the valve assembly of FIG. 5*a* before the introduction of the inflation nozzle;

FIG. 5*c* is a side view of the valve assembly of FIG. 5*a* illustrating the inflation nozzle engaging a flap of the valve assembly according to an embodiment of the present invention; and FIG. 6 is a schematic view of a method of making inflatable dunnage bags according to an embodiment of the present invention.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

In one aspect, and as shown in FIG. 1, the present invention provides an inflatable dunnage bag 10 for filling empty space within a container 12, such as a cardboard or paperboard box. The container 12 includes walls 14 that define an interior for storing one or more items 18, 20. As shown in FIG. 2*a*, the inflatable dunnage bag 10 may include a bag portion 22 and a valve assembly 24. In general, the valve assembly 24 is connected to the bag portion 22 and provides an internal passageway into the bag portion 22 for inflating the bag portion 22. The bag portion is generally pillow shaped when inflated. In the container, as shown in FIG. 1, the bag portion 22 may fill most of the empty space within the interior and conform to the items in the container 12, thereby restricting the items 18, 20 from shifting around. Also, the inflated bag portion 22 may increase the integrity and stacking strength of the container 12.

The bag portion may comprise a film such as a film comprising a flexible, sealable material. For example, the film may comprise one or more thermoplastic polymers such as one or more of any of the following: polyethylene homopolymer or copolymer, including low-, medium-, or high-density polyethylene, polypropylene homo- or copolymer, polyester, and polyamide. In addition, the film may have only one layer (monolayered) or may comprise multiple layers. For example, the film may include an outer layer comprising polyester or nylon for strength and abrasion resistance, and/or may comprise an inside or sealing layer comprising one or more of the polyethylenes listed above. The methods of forming the bag portion may vary. For example and as further explained below, the bag portion may be formed from a flattened tube of material. The two opposite and open ends of the tube of material may be sealed closed through a heat process forming two sealed ends of the bag portion. Another method of forming the bag portion includes sealing together the four sides of two separate sheets of material such that the bag portion has four sealed sides. Or the method may include taking a single sheet of material and folding it along a center line and sealing three sides together such that the bag portion has three sealed sides.

As shown in FIGS. 2*a* and 2*b*, the bag portion 22 may include a front film 46 and a back film 48, with each film extending between two sealed ends, referred to herein for descriptive purposes only as the top end 42 and the bottom end 44. The valve assembly 24 is connected to the bag portion 22 by the top end 42. More specifically, the valve assembly 24 may extend through the top end 42 such that one portion of the valve assembly, referred to as the outlet end 28, lies between the front film 46 and the back film 48 of the bag portion, and the other portion of the valve assembly, referred to as the inlet end 30, lies outside the bag portion.

According to an embodiment of the present invention and as shown in FIGS. 3*a* and 3*b*, the valve assembly 24 may comprise a front wall 32 and a back wall 34. For example, the front and back walls may comprise one or more of the thermoplastic polymers described above, such as a low-density polyethylene. As shown, the front and back walls 32, 34 may be heat sealed together along two opposed long edges 36, 38 and a top edge 37. The valve assembly 24 defines an internal passageway that extends from the inlet end 30 through the outlet end 28 and a bottom opening 39 to the interior of the bag. Furthermore, the internal passageway may include a valve mechanism 26 that is adapted to facilitate the flow of fluid into the bag and inhibit the flow of fluid out of the bag, also known as a one-way valve or one-way inflation valve. For example, the valve mechanism 26 may be produced by narrowing the internal passageway from the inlet end 30 to the bottom opening 39. This may be done by heat sealing the front and back walls 32, 34 together along two strips 50, 52. For example and as illustrated, the two strips may form a general "Y" shape, such that the width of the internal passageway decreases as it approaches the bottom opening. The general shape of the passageway may vary. Examples of other shapes that may be employed in the present invention include but are not limited to the shapes disclosed in U.S. Pat. Nos. 5,830,780 and 6,561,236, both of which are hereby incorporated by reference in their entirety. As explained in more detail further below, the valve assembly 24 may include a patch of ink 40 on an inner surface of one of the walls 32, 34.

Normally, the two sides of the valve mechanism 26, i.e. the front and back walls 32, 34, are in contact with each other and the internal passageway is closed. A fluid flow, such as an air flow, introduced from the inlet end 30 toward the bottom opening 39 separates the front and back walls 32, 34 and opens the internal passageway such that the fluid flow enters and inflates the bag portion 22. Once the fluid flow is stopped the walls of the valve mechanism 26 naturally come back together, thereby inhibiting the fluid from escaping back through the internal passageway. The back pressure from the inflated bag portion 22 aids in sealing the internal passageway by encouraging the front and back walls 32, 34 together.

According to one of the features of the present invention, the valve assembly 24 may include a backing plate 54. The backing plate may be connected to or contained substantially within the inlet end 30 of the valve assembly. For example, the backing plate 54 or a portion of the backing plate 54 may lie between the front and back walls 32, 34, as shown in FIGS. 3*a* and 3*b*. Also, in addition to or instead of having a portion of the backing plate contained within the inlet end, a portion may be connected to either the front or back wall of the inlet end. For example, the front and back walls may be sealed to portions of the backing plate either by heat or an adhesive or the backing plate may be connected to the back wall outside of the inlet end. For another example, an upper portion of the backing plate may extend through the top edge of the inlet end and a lower portion of the backing plate may be contained within the inlet end. In this example, the front and back walls may or may not be sealed to the upper portion of the backing plate. And thus in the case of not sealing, the top edge of the inlet end may be partially or completely unsealed.

The backing plate may be more rigid than the bag portion and/or the front and back walls 32, 34 of the valve assembly. For example, according to one embodiment, the bag portion and the front and back walls of the valve assembly may comprise a low density polyethylene while the backing plate may comprise medium or high density polyethylene. Further, the backing plate may be thicker than the thickness of the front and back walls 32, 34, for example any of at least 10, 20, 30, 50, and 80 times as thick as the front wall 32. The backing plate may be resilient (e.g., comprise a resilient material) so that when the backing plate is bent or folded (for example when folded with a flap of the container) the backing plate may bias at least a portion of the valve assembly (e.g., the front wall 32) against an inner surface of the container for receiving the inflation nozzle, as discussed in more detail below with regards to the inflation process. Also, although the term "plate" is used herein to describe the illustrated backing plate 54, the term should not be construed as being limited to a flat structure having a uniform thickness, and any shape that achieves one or more of the features of the described backing plate 54 should be construed to fall within the scope of the invention.

The backing plate may include a projection 56 and a flap 58. According to the illustrated embodiment, the backing plate 54 has a general rectangular overall shape that matches the overall shape of the inlet end 30. The projection 56 may extend from near the top of a longitudinal side of the backing plate 54 through the longitudinal sealed edge 38 of the inlet end 30 and toward the bag portion. Also, the projection 56 may extend beyond the front and back walls 32, 34 of the inlet end 30 and/or the front and back walls 32, 34 may be sealed (e.g., heat or adhesively) to the projection 56. In general, the projection 56 may define an upper portion of the backing plate 54 extending above the projection 56 and a lower portion of the backing plate 54 extending below the projection 56. The lower portion of the backing plate 54 may include a central opening 60 for the flap 58. The flap is configured to be pivotal from the rest of the backing plate 54 through the central opening 60.

The projection 56 is configured to engage a wall 14 of the container 12 for positioning the valve assembly 24 within the container 12, as illustrated in FIGS. 4*a* and 4*b*. More specifically, the projection 56 aligns the front wall 32 of the inlet end 30 near or against a predetermined area of an inner surface of an wall 14 of the container 12 for an inflation process. For example and as illustrated, the projection 56 may be shaped as a hook that positions the valve assembly by straddling a first wall of the container, such that the hook is adjacent the outer surface of the first wall and the front wall of the inlet end is adjacent an inner surface of a second wall of the container that is generally perpendicular to the first wall. In another embodiment, the hook may be inserted into the first wall, such that hook is within a corrugated flute structure of the wall. Although the projection is shaped as a hook in the illustrated embodiment, the shape of the projection may vary. For example the projection may be a lip, a hanger, or any other configuration suitable for engaging the container for positioning or aligning the front wall of the inlet end near or against a wall of the container.

As shown in FIGS. 5*a* through 5*c*, during the inflation process, an inflation nozzle 64 may puncture through the predetermined area of the outer wall 14 of the container and engage the front wall 32 of the inlet end. For example and as shown, the inflation nozzle may puncture the outer wall of the container and puncture the front wall at the inlet end and thereby create an entrance for the nozzle to the internal passageway defined by the valve assembly. Or the inflation nozzle may puncture the outer wall of the container and enter through the front wall by a pre-cut hole as further disclosed in U.S. Pat. No. 6,561,236.

The backing plate 54 may be positioned between the front wall 32 and the back wall 34 such that the backing plate 54 protects the back wall 34 from the nozzle 64 when the nozzle punctures or enters through the front wall 32. Moreover, the flap 58 may be aligned with the nozzle 64 such that nozzle 64 engages the flap 58 as the nozzle 64 enters the inlet end 30. The engagement of the nozzle 64 against the flap 58 causes the flap to pivot away from the nozzle which in turn causes the flap 58 to engage and further protect the back wall 34 by moving the back wall away from the nozzle 64, as best illustrated by FIG. 5*c*. The pivoted flap 58 may also facilitate the flow of the inflation fluid (e.g., air) from the nozzle through the internal passageway to the bag portion by directing the fluid generally downwards through the internal passageway defined by the valve assembly 24, also illustrated by FIG. 5*c*.

According to an embodiment of the present invention, the backing plate 54 may also define a bottom break 62 of material below the flap 58. When the flap 58 is moving the back wall 34 away from the inflation nozzle 64, the longitudinal edges 36, 38 of the inlet end 30 will be encouraged to move inwardly to compensate for the movement of the back wall 34. In other words, the bottom break 62 facilitates the flexing of the backing plate 54 inwardly along with the longitudinal edges 36, 38 such that more room for the back wall 34, and thus the flap 58, is provided in a backward direction. This facilitates a deeper penetration of the inflation nozzle 64 into the inlet end 30 and promotes a more efficient inflation process.

Another feature of the present invention is a method of packaging one or more items within a container for shipping and handling. According to an embodiment of the present invention, one or more items are placed within a container along with the bag portion and the connected valve assembly as described above. The front wall of the valve assembly is positioned near or against the inner surface of a predetermined area of an outer wall of the container. The front wall 32 is positioned by engaging the projection 56 of the valve assembly onto the wall of the container, as shown in FIGS. 4*a* and 4*b*. After positioning the bag portion and the valve assembly within the container, the container may be closed. For example, the container may be a cardboard box with a top opening closable by two pairs of opposing flaps. As shown in FIG. 4*c*, a set of opposing minor flaps 66, 67 that are generally perpendicular to the backing plate 54 of the valve assembly may be closed first such that one of the minor flaps 66 extends across the width of the backing plate 54. Then the pair of major flaps 68, 69 may be closed, as shown in FIG. 4*d*.

Due to an upper portion of the backing plate 54 extending above the box, one of the major flaps 68 may fold over the upper portion of the backing plate 54 while the minor flap 66 holds the backing plate 54 in place. Furthermore, folding the upper portion of the backing plate in a first direction that is essentially away from the inner surface of the wall creates a spring or biasing force in the lower portion of the backing plate such that the central opening and the front wall of the valve assembly is further encouraged against the inner surface of the wall of the container in a second direction (i.e. toward the inflation nozzle). To hold the flaps in a closed position the flaps may be taped. With the flaps 66, 68 closed the upper portion of the backing plate 54 remains in a folded position between the flaps 66, 68 as shown in FIGS. 5*b* and 5*c*, while the lower portion of the backing plate 54 is encouraged against the inner surface of the outer wall of the container.

Next, and as shown in FIGS. 5*a* and 5*c*, the inflation nozzle 64 may puncture through the predetermined area of the outer wall 14 and the front wall 32 of the inlet end and thus create an entrance into the internal passageway defined by the valve assembly 24. In particular, the spring or biasing force created by the folded over top end of the backing plate 54 helps to hold the front wall 32 in place such that the inflation nozzle 64 punctures through the front wall 32 rather than just push the front wall 32 away from the inner surface of the outer wall 14 and nozzle 64. Once inserted into the inlet end of the valve assembly, the inflation nozzle can deliver a fluid flow through the internal passageway and into the bag portion and thus inflate the bag portion such that bag portion occupies most of the empty space within the box, as illustrated in FIG. 1.

The type of inflation nozzle and other machinery used to delivery and monitor the fluid flow may vary. For example, the inflation nozzle may be part of an inflation apparatus disclosed in U.S. Pat. No. 6,253,806; 6,253,919; 6,561,236; or 6,729,110, all of which are hereby incorporated by reference in their entirety. Examples of inflation fluids include gas, such as air or lighter-than-air gas, and liquids, such as liquid water or one or more liquid precursors that may subsequently react, for example, to form a foam.

Yet another feature of the present invention is providing and producing a supply of inflatable dunnage bags. The method may include providing a tubular stock of material. For example and as shown in FIG. 6, the tubular stock of material 72 may be from a supply roll 74. The material 72 is advanced in a downstream direction (indicated by the arrow) in a flat manner such that the material 72 defines a top film 86 and a bottom film 88. At a first station 76, a first heat seal 78 is formed across the width of the material 72. On the upstream side of the first heat seal 78, a first line of weakening 80 is formed across the width of the material 72. For example, the line of weakening 80 may comprise a series of perforations or scoring. A portion of a valve assembly 84, which may also be supplied by a supply roll, is inserted between the top film 86 and the bottom film 88 of the material 72. More specifically, the valve assembly 84 may be inserted by opening a portion of the first line of weakening 80 and inserting the portion of the valve assembly 84 between the top film 86 and the bottom film 88 in an upstream direction away from the adjacent first heat seal 78. Once the valve assembly 84 is inserted a second heat seal line 90 is formed across the width of the material 72 and the valve assembly 84 on the upstream side of the first line of weakening 80 at a second station 82. The second heat seal line 90 connects the valve assembly 84 to the material 72.

In another embodiment instead of connecting the valve assembly by inserting it through an opened portion of a line of weakening, the valve assembly may be connected along the side of the tube of material. For example, instead of tubular material, the material may be a sheet folded along a center line such that material defines a top film and a bottom film and an opened side edge. The valve assembly may be connected by inserting a portion of the valve assembly into the opened side edge and then forming a seal along the side edge to connect the valve assembly and seal the side edge.

An internal passageway of the valve assembly may include a patch of ink (seen best in FIGS. 2*a* and 3*a* as 40) at the point that the second heat seal line crosses the valve assembly. The purpose of the patch of ink is to prevent the two walls of the valve assembly 84 from adhering to each other during the heat sealing process and thereby blocking the internal passageway. It is not necessary to use ink, and other known methods of preventing the heat seal could be used, including a patch of a different coating applied to the walls or an insert placed between the walls.

The above steps of forming a first heat seal line 78, forming a first line of weakening 80, inserting a valve assembly 84, and forming a second heat seal line 90 may be repeated at set intervals along the length of tubular material 72 and thereby produce a number of inflatable dunnage bags. More specifically, each second seal line with a connected valve assembly defines a top end of an inflatable dunnage bag. The inflatable dunnage bag extends in an upstream direction to a first seal line, wherein the first seal line defines the bottom end of the inflatable dunnage bag. Adjacent inflatable dunnage bags are delimited by the first lines of weakening and may be detachable along the first lines of weakening. This arrangement allows the inflatable dunnage bags to be rolled up into a roll supply of inflatable dunnage bags 92, which makes subsequent use for packing operations more efficient. Furthermore, as shown in FIG. 6, before rolling up the inflatable dunnage bags, the tube of material may be folded in its length direction by a folding plow 94 or other device in order to compact the width of the supply roll of inflatable dunnage bags 92.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An inflatable dunnage bag comprising:

a bag portion;

a valve assembly connected to the bag portion for allowing an inflation nozzle to inflate the bag portion; and a backing plate having an upper portion and a lower portion;

wherein the upper portion is foldable relative to the lower portion so that the lower portion biases at least a portion of the valve assembly in a direction toward the inflation nozzle when the upper portion is folded.

2. The inflatable dunnage bag according to claim 1, wherein the bag portion defines a top end and the valve assembly is connected to the top end of the bag portion.

3. The inflatable dunnage bag according to claim 1, wherein the backing plate includes a projection for positioning the valve assembly.

4. The inflatable dunnage bag according to claim 3, wherein the valve assembly includes a front wall and a back wall and the backing plate is positioned substantially between the front wall and the back wall, and wherein the backing plate is configured to protect the back wall from the inflation nozzle inserted through the front wall during an inflation process.

5. The inflatable dunnage bag according to claim 4, wherein the backing plate includes a flap adapted to move the back wall away from the inflation nozzle and direct a fluid flow from the inflation nozzle through the valve assembly to the bag portion during the inflation process.

6. The inflatable dunnage bag according to claim 5, wherein the valve assembly further comprises a valve mechanism which allows a fluid into the bag portion during the inflation process and inhibits the fluid from escaping from the bag portion when the bag portion is inflated.

7. The inflatable dunnage bag according to claim 5, wherein the backing plate comprises a resilient material and defines a break in the resilient material for flexibility.

8. An inflatable dunnage bag comprising:

a bag portion; and a valve assembly connected to the bag portion for allowing an inflation nozzle to inflate the bag portion, the valve assembly comprising;

a front wall, a back wall, and a backing plate positioned between the front wall and the back wall such that the backing plate protects the back wall from the inflation nozzle inserted into the valve assembly during an inflation process, wherein the backing plate includes a flap adapted to move the back wall away from the inflation nozzle and direct a fluid flow from the inflation nozzle through the valve assembly to the bag portion during the inflation process.

9. An inflatable dunnage bag comprising:

a bag portion; and a valve assembly connected to the bag portion for allowing an inflation nozzle to inflate the bag portion, the valve assembly comprising;

a front wall, a back wall, and a backing plate positioned between the front wall and the back wall such that the backing plate protects the back wall from the inflation nozzle inserted into the valve assembly during an inflation process, wherein the backing plate defines a hook for positioning the valve assembly within a container.

10. The inflatable dunnage bag according to claim 9, wherein the hook extends beyond the front wall and the back wall of the valve assembly.

11. An inflatable dunnage bag comprising:

a bag portion; and a valve assembly connected to the bag portion for allowing an inflation nozzle to inflate the bag portion, the valve assembly comprising;

a front wall, a back wall, and a backing plate positioned between the front wall and the back wall such that the backing plate protects the back wall from the inflation nozzle inserted into the valve assembly during an inflation process, wherein the valve assembly further comprises a valve mechanism that allows a fluid into the bag portion during the inflation process and inhibits the fluid from escaping from the bag portion when the bag portion is inflated.

12. An inflatable dunnage bag comprising:

a bag portion; and a valve assembly connected to the bag portion for allowing an inflation nozzle to inflate the bag portion, the valve assembly comprising;

a front wall, a back wall, and a backing plate positioned between the front wall and the back wall such that the backing plate protects the back wall from the inflation nozzle inserted into the valve assembly during an inflation process, wherein the backing plate is more rigid than the front wall.

13. An inflatable dunnage bag comprising:

a bag portion; and a valve assembly connected to the bag portion for allowing an inflation nozzle to inflate the bag portion, the valve assembly comprising;

a front wall, a back wall, and a backing plate positioned between the front wall and the back wall such that the backing plate protects the back wall from the inflation nozzle inserted into the valve assembly during an inflation process, wherein the bag portion defines a top end and the valve assembly is connected to the top end of the bag portion.

14. An inflatable dunnage bag for a container defining a first wall, the inflatable dunnage bag comprising:

a bag portion;

a valve assembly connected to the bag portion for allowing an inflation nozzle to inflate the bag portion; and a backing plate having a projection, an upper portion extending above the projection, and a lower portion extending below the projection;

wherein the projection engages the container such that the valve assembly is adjacent to the first wall of the container.

15. The inflatable dunnage bag according to claim 14, wherein the container has a top edge defining an opening and a plurality of flaps for closing the opening, and the upper portion of the backing plate extends above the top edge of the container such that the upper portion is foldable by at least one of the flaps and the folding of the upper portion encourages the valve assembly against an inner surface of the first wall of the container.

16. The inflatable dunnage bag according to claim 14, wherein the container defines a second wall and the projection is shaped as a hook for engaging the second wall and positioning the valve assembly adjacent to the first wall of the container.

17. The inflatable dunnage bag according to claim 14, wherein the lower portion of the backing plate is between a front wall and a back wall of the valve assembly.

18. The inflatable dunnage bag according to claim 17, wherein the upper portion of the plate extends beyond the front wall and back wall of the valve assembly.

19. An inflatable dunnage bag for a container having a first wall, the inflatable dunnage bag comprising:

a bag portion;

a valve assembly connected to the bag portion for allowing an inflation nozzle to inflate the bag portion, wherein the valve assembly includes a front wall and a back wall; and a hook assembly configured to position the bag portion within the container such that the front wall of the valve assembly is adjacent to an inner surface of the first wall of the container.

* * * * *